US006257788B1

(12) United States Patent
Gueret

(10) Patent No.: US 6,257,788 B1
(45) **Date of Patent: *Jul. 10, 2001**

(54) NAIL-VARNISH APPLICATOR ARRANGEMENT

(75) Inventor: Jean-Louis Gueret, Paris (FR)

(73) Assignee: L'Oreal, Paris (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/659,308

(22) Filed: Jun. 6, 1996

(30) Foreign Application Priority Data

Jun. 6, 1995 (FR) ..... 95 06658

(51) Int. Cl.[7] ..... A46B 11/00
(52) U.S. Cl. ..... 401/129; 401/126
(58) Field of Search ..... 401/121, 122, 401/129, 126, 130, 118

(56) References Cited

U.S. PATENT DOCUMENTS

| | | | | |
|---|---|---|---|---|
| 372,737 | * | 11/1887 | Bartlett | 401/122 |
| 869,431 | * | 10/1907 | Gibson | 401/129 |
| 2,011,414 | * | 8/1935 | Oldham | 401/130 |
| 2,093,189 | | 9/1937 | Edmunds . | |
| 2,550,586 | * | 4/1951 | Nardone | 401/129 |
| 2,803,028 | * | 8/1957 | Flynn | 401/129 |
| 3,185,291 | * | 5/1965 | Lerner | 401/129 X |
| 3,870,186 | * | 3/1975 | Reinhard | 401/129 X |
| 4,733,788 | | 3/1988 | D'Amico . | |
| 4,761,088 | * | 8/1988 | Zubek | 401/129 X |

FOREIGN PATENT DOCUMENTS

| | | | | |
|---|---|---|---|---|
| 535 167 | | 5/1973 | (CH) . | |
| 2545952 | * | 4/1977 | (DE) | 401/122 |
| 0 567 358 | | 10/1993 | (EP) . | |
| 864 754 | | 5/1941 | (FR) . | |
| 989064 | * | 9/1951 | (FR) | 401/121 |
| 1063448 | | 5/1954 | (FR) . | |
| 1 076 477 | | 10/1954 | (FR) . | |
| 1111431 | | 2/1956 | (FR) . | |
| 1 353 818 | | 1/1964 | (FR) . | |
| 1 566 737 | | 3/1969 | (FR) . | |
| 27617 | | of 1912 | (GB) . | |
| 18115 | | of 1915 | (GB) . | |
| 686020 | | 1/1953 | (GB) . | |
| 983283 | * | 2/1965 | (GB) | 401/129 |
| 1039022 | | 8/1966 | (GB) . | |
| WO 94/29181 | | 12/1994 | (WO) . | |

* cited by examiner

*Primary Examiner*—David J. Walczak
(74) *Attorney, Agent, or Firm*—Finnegan, Henderson, Farabow, Garrett & Dunner, L.L.P.

(57) ABSTRACT

An arrangement for applying a liquid or viscous product, comprising a reservoir (4) including a neck (8) and a cap (6) carrying an applicator member (20) which, in the storage position, is immersed in the product contained in this reservoir. The neck includes a base (10) and an upper end (13). The upper end of the neck has a profile such that, when the applicator member is wrung out on this end, the wrung-out product flows essentially down the internal wall (21) of the reservoir. For this purpose, the upper edge of the neck is sharp.

57 Claims, 3 Drawing Sheets

NAIL-VARNISH APPLICATOR ARRANGEMENT

FIELD OF THE INVENTION

The invention relates to an arrangement for applying a liquid or viscous product which is found in the fields of cosmetics, paints or adhesives. In the field of cosmetics, the product may be a nail-varnish composition or other nail care composition.

BACKGROUND OF THE INVENTION

In general, a nail-varnish applicator arrangement comprises a reservoir for the product to be applied and a product applicator, such as a brush including a tuft of bristles, fixed to a first end of a wand, the wand being fixed by its other end into a cap intended to close the reservoir so that the tuft of bristles is immersed in this product when the applicator arrangement is closed.

In order to ensure good closure of the arrangement, the reservoir includes a neck equipped with a first screw thread which interacts with a second screw thread provided in the cap. The neck is generally thick and flat and equipped with a sealing ring. The wand is held in the cap via a support which comprises a sealing disc. This sealing disc is in contact with the sealing ring of the neck when the applicator arrangement is closed. The screw thread is formed along the entire height of the neck and comes flush with the upper end of the neck.

In order to apply the product to a nail, the applicator member which is impregnated with product is withdrawn from the reservoir. In general, the brush has an excess of product. It is therefore necessary to remove this excess of product and for that, the user wrings the brush out by wiping it on the end of the neck of the reservoir. As the end of the neck is flat and thick and constitutes a bearing surface, some product will remain on the neck and run along the external wall of the neck and thus soil the screw thread of the neck. When the cap is again screwed back on to close the reservoir, the product spreads out over the neck and into the screw thread. When it has dried, the product thus forms a dirty mark on the cap/neck arrangement. Upon subsequent use it is then difficult, and sometimes even impossible, to unscrew the cap from the reservoir. Furthermore, the product on the neck no longer allows the applicator arrangement to be sealed correctly because the sealing disc is no longer in leak-tight contact with the sealing ring of the neck. Furthermore, because the disc bears on the end of the neck, the disc no longer perfectly matches the relief of the end of the neck when the end is soiled after first use, and this further reduces the sealing effect.

In order to avoid dirtying the screw thread of the neck, Patent CH-C-535,167 proposes to extend the orifice of the neck using a tube having a flat and thick end. When the cap is screwed onto the bottle, a gap remains between the lateral wall of the cap and the wall of the tube preventing the excess product from soiling the screw thread of the neck. However, in the event of a substantial amount of product flowing down along the external wall of the tube, after the brush has been wrung out on the flat end of the tube, the screw thread of the neck may after all become soiled with product. In addition, owing to the flat end of the tube, a deposit of product is formed after each wringing-out operation, leading to a reduction in the sealing effect.

The present invention therefore aims to overcome the abovementioned drawbacks.

OBJECT OF THE INVENTION

The object of the present invention is, in particular, to provide an applicator arrangement which allows the applicator member to be better wrung out while at the same time avoiding soiling the neck of the reservoir. Another of its objectives is to propose means which allow the applicator arrangement to be sealed well.

APPLICANT SUMMARY OF THE INVENTION

Applicant has discovered, unexpectedly and surprisingly, that such results could be obtained by giving the upper end of the neck a profile which prevents any wrung-out product from flowing down the external wall of the neck.

The present invention therefore provides an arrangement for applying a liquid or viscous product, comprising a reservoir including a neck and a cap carrying an applicator member which, in the storage position, is immersed in the product contained in this reservoir, the neck including a base and an upper end, characterized in that the upper end of the neck has a profile such that when the applicator member is wrung out on this end, the wrung out product flows essentially down the internal wall of the reservoir. More particularly, this profile has no bearing surface.

In addition, the invention also provides an arrangement for applying a liquid or viscous product, comprising a reservoir including a neck and a cap carrying an applicator member which, in the storage position, is immersed in the product contained in this reservoir, the neck including a base and an upper end, characterized in that the upper end of the neck has no bearing surface.

Preferably, the upper end includes a ridge. This ridge makes it possible to wring out the applicator member well. In particular, during wringing-out, all of the wrung out excess product flows into the internal space of the reservoir. In this way, any flow of product along the external wall of the neck is prevented, and soiling of this neck is thus avoided.

The term cap is intended to denote any element capable of holding the applicator member in the reservoir, without this element hermetically closing the reservoir.

The applicator arrangement according to the invention, although recommended for the packaging of nail-varnish, may prove suitable for the application of any other liquid or viscous product, and in particular paints, especially paints for models and for drawings, and adhesives.

Advantageously, the upper end is equipped with a first ridge and with at least one second ridge, the first ridge being at a level above the level of the second ridge, the levels being measured along an axis (X) of the reservoir.

Advantageously, the upper end of the neck may be equipped with a first ridge and with at least one second ridge, the first ridge being at a level above that of the second ridge, relative to the axis X.

The profile of the upper end of the neck according to the invention may be produced on the whole of the end or on just part of it. In the latter case, the applicator member is wrung out only on the profiled part of the neck.

According to the invention, the ridge may be sharp (that is to say defined by the intersection of two planes) truncated or rounded. When the ridge is truncated, its thickness, measured in a plane perpendicular to the axis (X) does not exceed 2 mm and preferably ranges from 0.2 mm to 0.5 mm.

Advantageously the said first ridge is defined by the intersection of two planes forming an acute angle.

According to a specific embodiment of the invention, the neck includes at least one screw thread situated on the base.

Advantageously, the cap includes a sealing disc. In this case, the profile of the upper end of the neck provides better contact with the sealing disc of the cap, and therefore improves the overall leak-tightness of the applicator arrangement. In particular, the projecting ridge of the neck allows easy deformation of the sealing disc after the cap is screwed on, this deformation making it possible to maintain a perfect seal between the neck and the cap. What is more, the small thickness of the ridge facilitates the removal of any deposit of product on the ridge during deformation of the sealing disc during screwing.

Furthermore, the neck may include a lip surmounting the base and terminating in the said upper end of the neck. The lip thus permits greater ease for wringing out the applicator member, allowing the applicator member to be wrung out better and with greater precision.

Advantageously, the base may have a wall thickness $e_1$ and the lip may have a wall thickness $e_2$ in the direction orthogonal to the axis X which is less than $e_1$, these thicknesses being measured in a direction orthogonal to the axis (X).

According to the invention, the ratio $e_2/e_1$ is preferably less than 0.9 and, preferably, ranges from 0.1 to 0.8.

Advantageously, the base has a height H and the lip has a height h which are such that the ratio h/H is less than 6 and preferably ranges from 0.03 to 4, the heights H and h being measured along the axis X of the reservoir.

In accordance with the invention, the neck comprises an upper neck portion and a lower neck portion adjoining the upper neck portion. The lower portion of the neck has screw threading configured to cooperate with internal screw threading associated with the cap. The screw threading may terminate where the lower neck portion adjoins the upper neck portion. Alternatively, the screw threading may terminate below where the lower neck portion adjoins the upper neck portion.

In an aspect of the invention, the neck may comprise a shoulder defined by a difference in outer diameter between the upper neck portion and the lower neck portion. The shoulder may be located where the upper portion adjoins the lower neck portion.

According to the invention, the cross-section of the internal wall of the neck may be constant or variable, along the axis X. In particular, the internal cross-section of the upper part of the neck situated towards the upper end may be smaller than the internal cross-section of the lower part of the neck situated towards the reservoir. The neck then exhibits an internal restriction, especially one in the shape of a cone, the larger opening of which is directed towards the bottom of the reservoir. This profile of the internal wall makes it possible for the applicator member to be wrung out right inside the reservoir, before wringing it out on the upper end of the neck. In addition, the withdrawal of the applicator member from the reservoir is thereby made easier. Indeed, the lower part of larger internal cross-section makes it possible to angle the applicator member with respect to the axis (X) more easily when withdrawing it from the reservoir.

According to the invention, the neck may be made as a single piece, which makes it possible to reduce the costs of manufacturing the applicator arrangement.

Preferably, the reservoir with the neck may be made as a single piece. The reservoir may consist of glass, plastic or metal. Furthermore, the reservoir may include an attached bottom. What is more, it may be made of a material which is treated "in the piece" or treated on the outside (external face), with a view to making it more slippery to limit the adherence of the product and/or improve the aesthetic appearance and/or limit the brittleness.

In another alternative form of the invention, the cap may include a cap insert. The cap insert may be equipped with a screw thread interacting with the screw thread of the base.

The neck may include a counter-ring integral with the reservoir and which carries the base. Preferably, the external diameter of the counter-ring is substantially close to the external diameter of the cap but may be larger or smaller.

The applicator member may be a brush, a foam, a pen, a flocked plastic or a moulded plastic.

When the applicator member is a brush, it consists of a tuft of bristles; it is possible for the bristles to be made of any substance and in any form which are known to those skilled in the art.

BRIEF DESCRIPTION OF THE DRAWINGS

Apart from the provisions explained hereinabove, the invention consists of a certain number of other provisions which will be dealt with more fully afterwards, with regard to embodiments described with reference to the attached drawings, but which are not in any way limiting.

DETAILED DESCRIPTION OF THE PREFERRED EMBODIMENTS

Figure 1:
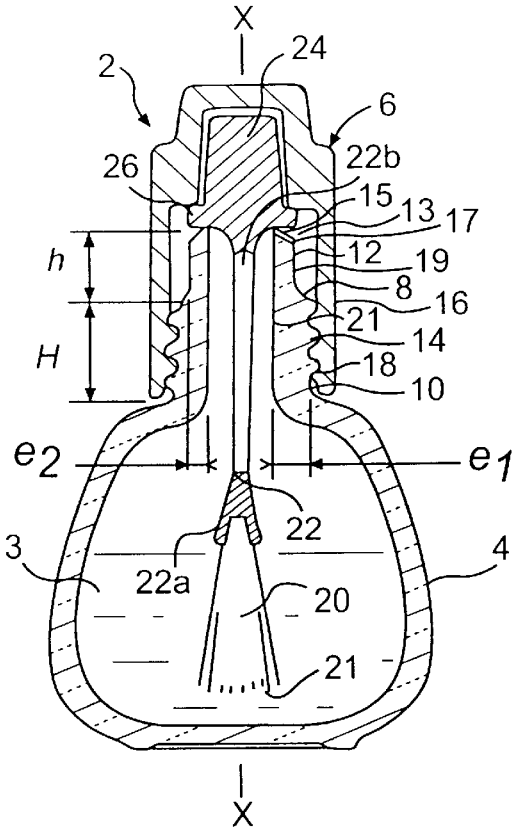
FIG. 1 is an axial section of an applicator arrangement in accordance with a first alternative form of the invention.
Figure 2:
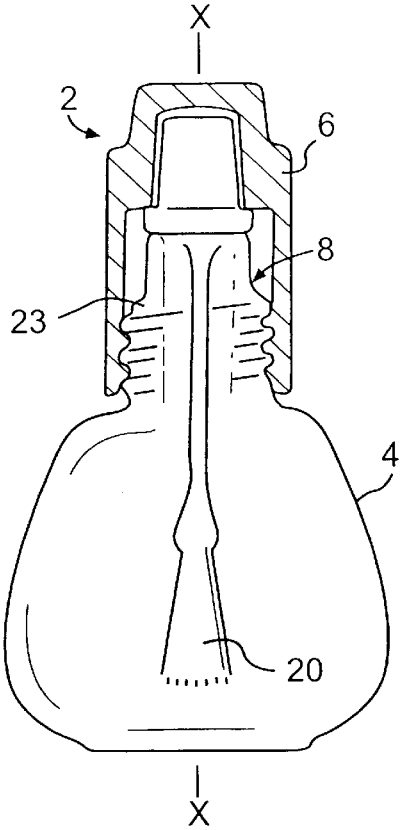
FIG. 2 is an elevation, with partial section, of the applicator arrangement of FIG. 1.

Referring to FIGS. 1 and 2, there is shown an applicator arrangement denoted overall by the reference 2, including a reservoir 4 having a longitudinal axis of symmetry (X), and a cap 6. The reservoir 4 contains a liquid or viscous product 3 to be applied, which may, for example, be a nail-varnish composition.

Figure 1A:
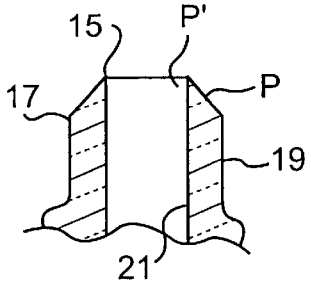
FIG. 1*a* shows the upper end of the neck in detail.

The reservoir 4 comprises a neck 8 including a base 10 supporting a lip 12, this lip having a wall thickness $e_2$ in the direction orthogonal to the axis X and a height h in the direction of the axis X. The internal diameter of the neck is substantially constant. Furthermore, the base 10 includes a screw thread 14 which is remote from the upper open end 13 of the lip 12. This free end 13 of the neck includes a first projecting ridge 15 situated above a second ridge 17, measured along the axis X. The ridge 15 is situated on the internal wall 21 of the neck whereas the second ridge 17 is situated on the external wall 19 of the neck. It can be seen, in FIG. 1*a*, that the ridge 15 is defined by two planes P and P' which form an acute angle between them. The plane P forms an obtuse angle with the axis X, measured in the clockwise direction.

The base 10 has a wall thickness $e_1$ measured at the bottom of the flight of the screw thread 14, in the direction orthogonal to the axis X and a height H in the direction of the axis X. As may be seen in FIG. 1, the thickness $e_2$ is less than the thickness $e_1$. By way of example, for a bottle of nail-varnish or nail-care product, $e_2$ may be chosen from 1 to 4 mm and $e_1$ from 5 to 10 mm. More specifically, $e_1$ is equal to 7 mm and $e_2$ is equal to 2 mm. What is more, for a bottle of nail-varnish or nail-care product, h is chosen, in practice, from 1 to 12 mm and $H \leqq 3$ mm and possibly as much as 30 mm.

The reservoir/base/lip arrangement is made as a single piece, especially of glass.

As shown in FIG. 2, the neck 8 includes a shoulder 23.

The cap 6 includes a skirt 16, the internal wall of which is equipped with a screw thread 18 which complements the screw thread 14 of the base 10. The cap 6 also includes an applicator member which, in this particular case, is a brush 20 comprising a tuft of bristles 21 which is fixed to the free end 22*a* of a wand 22. The other end 22*b* of the wand is fixed to a support 24 which is forcibly inserted into the cap 6. The support 24 includes a circular flat 26 which constitutes a sealing disc.

When the applicator arrangement is closed, the cap 6 is screwed onto the reservoir 4. The flat 26 is then compressed against the ridge 15 of the lip 12, then deformed over the contour of the ridge 15, thus sealing the applicator arrangement, even after several uses.

When the user wishes to apply some product 3, he or she unscrews the cap and withdraws the brush from the reservoir. The brush then, usually, has an excess of product. In order to wring out the brush, the user wipes it against the ridge 15 of the lip 12. As this ridge 15 is a projecting ridge, it allows the brush to be wrung out well and the wrung out product flows completely inside the reservoir 4. What is more, when the cap is screwed onto the neck, the sealing disc 26 is compressed against the ridge 15 and matches the shape of the latter. The small amount of product which may remain on the edges of the ridge 15 after the brush is wrung out is then pushed away from the ridge 15, leaving it perfectly clean and thus guaranteeing a very good seal.

Figure 3:
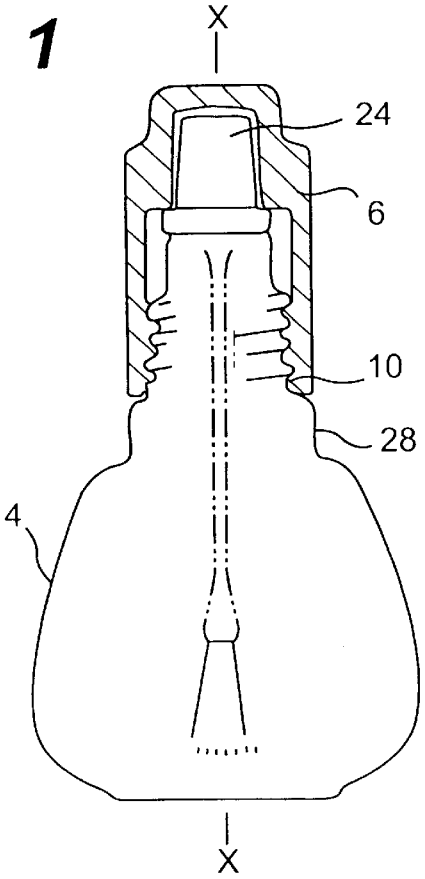
FIG. 3 is an elevation, with partial section, of an applicator arrangement in accordance with a second alternative form of the invention.

FIG. 3 shows an alternative form of the applicator arrangement which differs from the one in FIG. 1 in the shape of the neck. Thus, the neck has a counter-ring 28 integral with the reservoir and carrying the base 10. In this way a space is created in the reservoir, constituting an expansion chamber for the product. In addition to the counter-ring it is possible to provide a band for guiding the screwing of the cap onto the neck, this band being situated on the neck between the screw thread of the base and the counter-ring.

Figure 4:
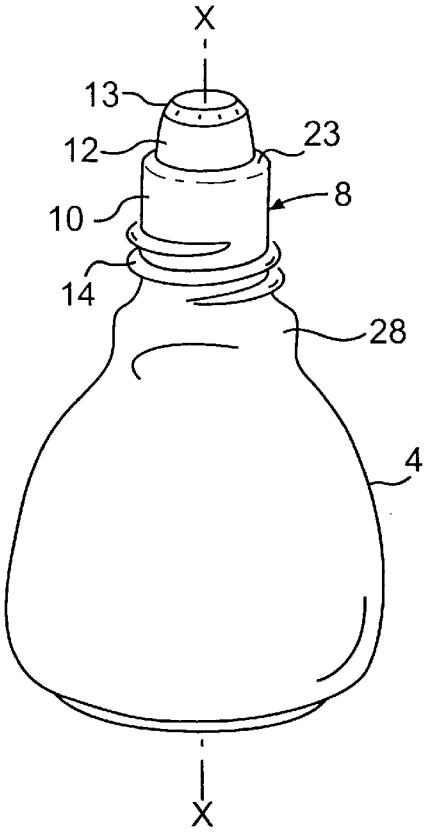
FIG. 4 is a perspective view of the reservoir of FIG. 3.

As shown in FIG. 4, the neck 8 includes a shoulder 23.

FIG. 4 shows an alternative form of the invention which differs from that of FIG. 3 in that the base 10 includes a screw thread 14 only at its bottom part, which is therefore further from the upper open end 13 of the lip 12 than in the arrangement of FIG. 3. This FIG. 4 shows that the profile of the upper end 13 of the neck 8 is uniform, that is to say continuous over the entire periphery of the end 13. However, the profile could just be on part of the periphery of the neck, the rest of the periphery having a flat profile.

Figure 5A:
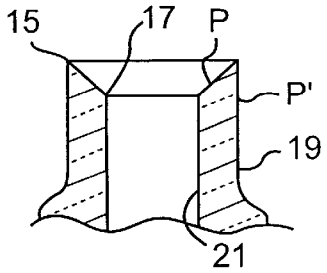
FIG. 5*a* shows the upper end of the neck in detail.
Figure 5:
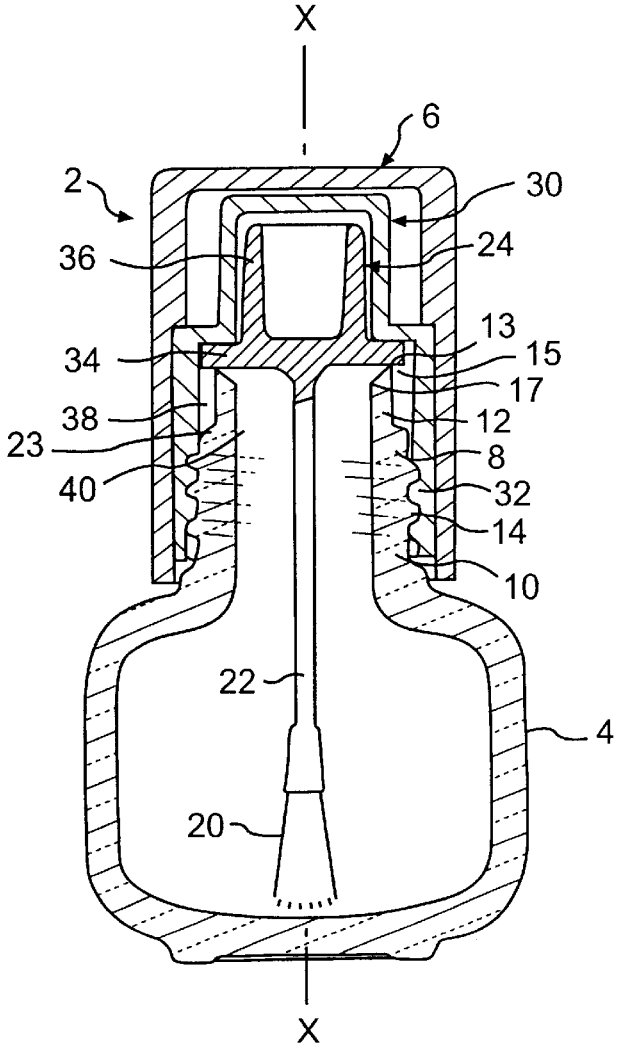
FIG. 5 is an axial section of an applicator arrangement in accordance with a third alternative form of the invention.

The applicator arrangement of FIG. 5 shows an alternative form of the invention which differs from that of FIG. 1 in the profile of the upper end 13 of the neck 8. As is better visible in FIG. 5*a*, the projecting ridge 15 is situated on the external wall 19 of the neck while the ridge 17 is situated on the internal wall 21 of the neck. What is more, the plane P defining the projecting ridge 15 with the plane P' forms an acute angle with the axis X measured in the clockwise direction. The planes P and P' also form an acute angle between them. In this configuration, the plane P makes it still easier for the excess product wrung out to flow down into the reservoir 4.

The cap 6 includes a cap insert 30 fitted into the cap 6 and which is equipped in its lower wall with a screw thread 32 intended to interact with the screw thread 14 of the base 10. The sealing disc 34 is provided with a collar 36 allowing the support 24 to be fixed forcibly into the cap insert 30.

In these alternative forms the disc 26 deforms on either side of the upper ridge 15, thus improving the seal of the applicator arrangement.

As shown in FIG. 5, the neck 8 includes a shoulder 23.

Figure 6:
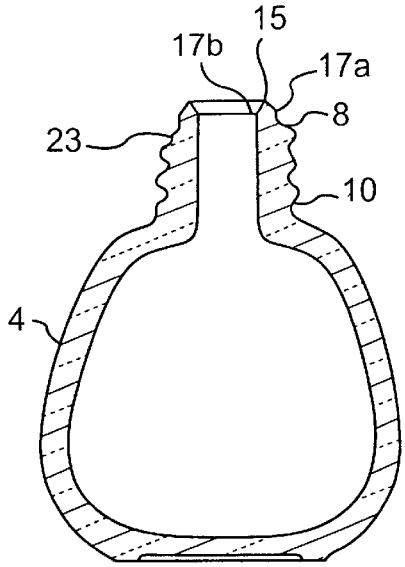
FIG. 6 represents an axial section of a reservoir in accordance with a fourth alternative form of the invention.
Figure 6A:
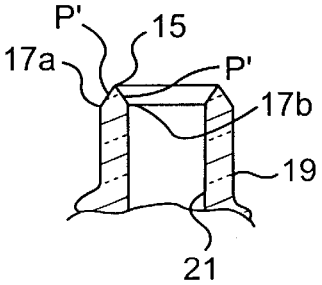
FIG. 6*a* shows the upper end of the neck in detail.

FIG. 6 shows a reservoir in which the base 10 of the neck 12 includes at its free end 13 two ridges 17*a*, 17*b* situated at the same level relative to the axis X, as well as a projecting ridge 15 situated above the ridges 17*a*, 17*b*. As is better visible in FIG. 6*a*, the ridge 17*a* is situated on the external wall 19 of the neck whereas the ridge 17*b* is situated on the internal wall 21 of the neck. The planes P and P' defining the projecting ridge 15 define an acute angle between them. What is more, the plane P forms an acute angle with the axis X while the plane P' forms an obtuse angle with the axis X, these angles being measured in the clockwise direction.

Figure 6B:
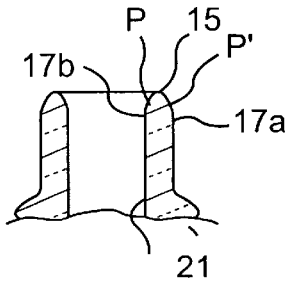
FIGS. 6*b* and 6*c* show alternative ways of producing the projecting ridge of the upper end of the neck.

FIG. 6*b* shows the ridge 15 with a rounded shape. The planes P and P' defining this ridge are curved.

Figure 6C:
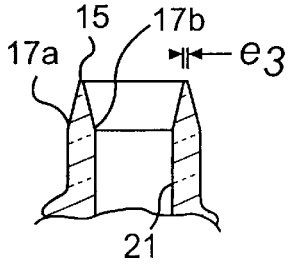

FIG. 6*c* shows the ridge 15 with a truncated shape. This ridge 15 has a thickness $e_3$ measured in a plane perpendicular to the axis X which may, for example, be 0.3 mm.

Figure 7:
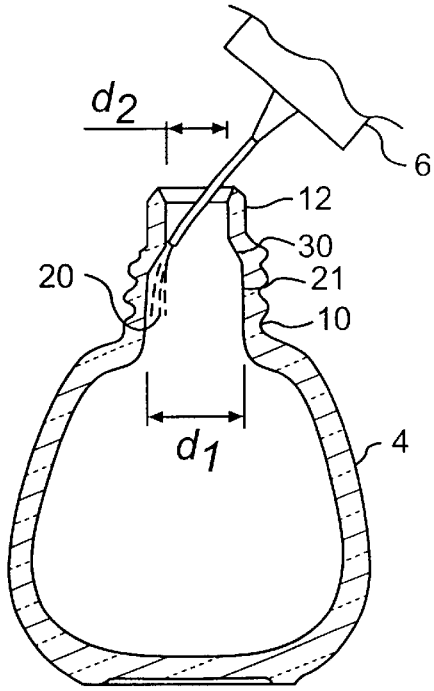
FIG. 7 represents an axial section of a reservoir in accordance with a fifth alternative form of the invention.

FIG. 7 shows a reservoir differing from the one in FIG. 6 by the configuration of the neck. Moreover, the base 10 of the neck is surmounted by a lip 12. This FIG. 7 shows that the internal diameter $d_1$ of the neck at the base 10 is larger than the internal diameter $d_2$ of the neck at the lip 12. The restriction zone 30 of the internal wall 21 of the neck makes it possible for the brush 20 to be wrung out beforehand when it is withdrawn from the reservoir 4, thus limiting the amount of product to be wrung out on the free end of the neck. What is more, the larger-diameter zone $d_1$ makes it easier for the brush 20 to be angled with respect to the axis X, thus making it easier to withdraw from the reservoir 4.

In order to limit the excess product on the brush when it is withdrawn from the reservoir, and therefore further reduce the soiling of the screw thread by comparison with applicator arrangements in the state of the art, it is possible to use a wand of a smaller diameter than that conventionally employed, for example a diameter smaller than 3 mm or ranging from 0.5 to 2.5 mm. The wand of the brush may also be mounted with the screw-on cap insert, as a single piece.

What is claimed is:

1. A nail varnish application system comprising:

a cap including internal screw threading;

a deformable seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, the external screw threading terminating where the lower portion of the neck adjoins the upper portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the edge on the upper neck portion contacts the seal to deform the seal and to remove, from the edge, any remaining nail varnish transferred to the edge during wiping of the application member on the edge, wherein the edge of the upper neck portion has a sharpness sufficient to provide the seal deformation and the removal of the remaining nail varnish, and wherein the edge of the upper neck portion is defined by one of:

a) an inclined surface extending upwardly from the internal wall surface of the neck to the external wall surface of the neck, b) an inclined surface extending downwardly from the internal wall surface of the neck to the external wall surface of the neck, and c) both a first inclined surface extending upwardly from the internal wall surface of the neck and a second inclined surface extending upwardly from the external wall surface.

2. The system of claim 1, wherein the upper portion of the neck has a first outer diameter and the lower portion of the neck has a second outer diameter, the first outer diameter being less than the second outer diameter.

3. The system of claim 2, wherein the cap has an inner radial surface configured such that when the cap is in the closed position a space is formed between the inner radial surface of the cap and an outer radial surface of the upper portion of the neck.

4. The system of claim 1, wherein the application member includes a tuft of a plurality of bristles extending from the end of the wand.

5. The system of claim 1, further comprising a support member attached to the cap, the support member and the seal being formed of a unitary, integral, single piece of material.

6. The system of claim 5, wherein the support member is forcibly inserted in the cap.

7. The system of claim 5, wherein the support member, seal, and the wand are formed of a unitary, integral, single piece of material.

8. The system of claim 1, wherein the edge is provided on the internal wall surface of the neck.

9. The system of claim 1, wherein the edge is provided on the external wall surface of the neck.

10. The system of claim 1, wherein the edge is provided between the internal wall surface of the neck and the external wall surface of the neck.

11. The system of claim 1, wherein a wall thickness of the upper portion of the neck is less than a wall thickness of the lower portion of the neck.

12. The system of claim 11, wherein a ratio of the wall thickness of the upper portion of the neck to wall thickness of the lower portion of the neck is less than 0.9.

13. The system of claim 12, wherein the ratio ranges from 0.1 to 0.8.

14. The system of claim 1, wherein a ratio of a height of the upper portion of the neck to a height of the lower portion of the neck is less than 6.

15. The system of claim 14, wherein the ratio ranges from 0.03 to 4.

16. The system of claim 1, wherein the cap is formed of a unitary, integral, single piece of material.

17. The system of claim 1, wherein the cap comprises an outer portion and an insert provided in the outer portion, the insert including the internal screw threading.

18. The system of claim 1, wherein the upper and lower parts of the passage have substantially the same cross-section.

19. The system of claim 1, wherein the upper part of the passage has a cross-section smaller than a cross-section of the lower part of the passage.

20. The system of claim 1, wherein the wand has an outer diameter less than 3 mm.

21. The system of claim 20, wherein the wand has an outer diameter ranging from 0.5 mm to 2.5 mm.

22. A method of applying nail varnish to a nail, comprising:

providing the system of claim 1, wherein nail varnish is provided on the application member;

wiping the application member on the edge of the upper neck portion to transfer any excess nail varnish to the reservoir;

placing the application member in contact with a nail to apply the nail varnish to the nail; and sealing the reservoir, wherein the sealing of the reservoir includes deforming the seal with the edge, and removing, from the edge, any remaining nail varnish transferred to the edge during wiping of the application member on the edge.

23. The method of claim 22, wherein the wiping of the application member transfers excess nail varnish to the reservoir and a portion of the wiped nail varnish remains on the edge.

24. The method of claim 23, wherein the portion of wiped nail varnish is removed from the edge during the sealing of the reservoir.

25. A method of sealing a nail varnish reservoir, comprising:

providing the nail varnish application system of claim 1;

rotating the cap relative to the reservoir to cause cooperation between the internal and external screw threading;

placing the edge of the upper neck portion in contact with the seal to remove, from the edge, any nail varnish; and deforming the seal with the sharp edge on the upper portion of the neck.

26. The method of claim 25, wherein the edge includes nail varnish and wherein the contact between the edge and the seal removes the nail varnish from the edge.

27. A nail varnish application system comprising:

a cap including internal screw threading;

a deformable seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, the external screw threading terminating where the lower portion of the neck adjoins the upper portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide deformation of the seal and the removal of the nail varnish from the edge, and wherein an outer diameter of each section of the upper portion of the neck is less than an outer diameter of each section of the lower portion of the neck.

28. A nail varnish application system comprising:

a cap including internal screw threading;

a deformable seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, the external screw threading terminating where the lower portion of the neck adjoins the upper portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide deformation of the seal and the removal of the nail varnish from the edge, and wherein a wall thickness of each section of the upper portion of the neck is less than a wall thickness of each section of the lower portion of the neck.

29. The system of claim 28, wherein a ratio of the wall thickness of the upper portion of the neck to the wall thickness of the lower portion of the neck is less than 0.9.

30. The system of claim 29, wherein the ratio ranges from 1.0 to 0.8

31. A nail varnish application system comprising:

a cap including internal screw threading;

a deformable seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, the external screw threading terminating where the lower portion of the neck adjoins the upper portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide deformation of the seal and the removal of the nail varnish from the edge, and wherein the edge of the upper neck portion is defined by one of:

a) an inclined surface extending upwardly from the internal wall surface of the neck to the external wall surface of the neck, b) an inclined surface extending downwardly from the internal wall surface of the neck to the external wall surface of the neck, and c) both a first inclined surface extending upwardly from the internal wall surface of the neck and a second inclined surface extending upwardly from the external wall surface.

32. The system of claim 31, wherein the edge is provided on the internal wall surface of the neck.

33. The system of claim 31, wherein the edge is provided on the external wall surface of the neck.

34. The system of claim 31, wherein the edge is provided between the internal wall surface of the neck and the external wall surface of the neck.

35. A nail varnish application system comprising:

a cap including internal screw threading;

a deformable seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, an upper end of the external screw threading terminating on the lower portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide deformation of the seal and the removal of the nail varnish from the edge, wherein the neck further comprises a shoulder where the upper portion of the neck adjoins the lower portion of the neck, the shoulder being defined by a difference in outer diameter between the upper portion of the neck and the lower portion of the neck, and wherein the edge of the upper neck portion is defined by one of:

a) an inclined surface extending upwardly from the internal wall surface of the neck to the external wall surface of the neck, b) an inclined surface extending downwardly from the internal wall surface of the neck to the external wall surface of the neck, and c) both a first inclined surface extending upwardly from the internal wall surface of the neck and a second inclined surface extending upwardly from the external wall surface.

36. The system of claim 35, wherein the edge is provided on the external wall surface of the neck.

37. The system of claim 35, wherein the edge is provided on the external wall surface of the neck.

38. The system of claim 35, wherein the edge is provided between the internal wall surface of the neck and the external wall surface of the neck.

39. A nail varnish application system comprising:

a cap including internal screw threading;

a deformable seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, an upper end of the external screw threading terminating on the lower portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide deformation of the seal and the removal of the nail varnish from the edge, wherein the neck further comprises a shoulder where the upper portion of the neck adjoins the lower portion of the neck, the shoulder being defined by a difference in outer diameter between the upper portion of the neck and the lower portion of the neck, and wherein an outer diameter of each section of the upper portion of the neck is less than an outer diameter of each section of the lower portion of the neck.

40. A nail varnish application system comprising:

a cap including internal screw threading;

a deformable seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, an upper end of the external screw threading terminating on the lower portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide deformation of the seal and the removal of the nail varnish from the edge, wherein the neck further comprises a shoulder where the upper portion of the neck adjoins the lower portion of the neck, the shoulder being defined by a difference in outer diameter between the upper portion of the neck and the lower portion of the neck, and wherein a wall thickness of each section of the upper portion of the neck is less than a wall thickness of each section of the lower portion of the neck.

41. The system of claim 40, wherein a ratio of the wall thickness of the upper portion of the neck to the wall thickness of the lower portion of the neck is less than 0.9.

42. The system of claim 40, wherein the ratio ranges from 0.1 to 0.8.

43. A method of applying nail varnish to a nail, comprising:

providing the system of claim 1, wherein nail varnish is provided on the application member;

wiping the application member on the edge of the upper neck portion to transfer any excess nail varnish to the reservoir;

placing the application member in contact with a nail to apply the nail varnish to the nail; and sealing the reservoir, wherein the sealing of the reservoir includes removing, from the edge, nail varnish transferred to the edge during wiping of the application member on the edge.

44. A method of sealing a nail varnish reservoir, comprising;

providing the nail varnish application system of claim 1, rotating the cap relative to the reservoir to cause cooperation between the internal and external screw threading; and placing the edge of the upper neck portion in contact with the seal to remove nail varnish from the edge.

45. The method of claim 44, further comprising deforming the seal so that a portion of the seal has a shape matching a shape of the edge.

46. A nail varnish application system comprising:

a cap including internal screw threading;

a seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, the external screw threading terminating where the lower portion of the neck adjoins the upper portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide the removal of the nail varnish from the edge, and wherein the edge of the upper neck portion is defined by one of:

a) an inclined surface extending upwardly from the internal wall surface of the neck to the external wall surface of the neck, b) an inclined surface extending downwardly from the internal wall surface of the neck to the external wall surface of the neck, and c) both a first inclined surface extending upwardly from the internal wall surface of the neck and a second inclined surface extending upwardly from the external wall surface.

47. A nail varnish application system comprising:

a cap including internal screw threading;

a seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, an upper end of the external screw threading terminating on the lower portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide the removal of the nail varnish from the edge, wherein the neck further comprises a shoulder where the upper portion of the neck adjoins the lower portion of the neck, the shoulder being defined by a difference in outer diameter between the upper portion of the neck and the lower portion of the neck, and wherein the edge of the upper neck portion is defined by one of:

a) an inclined surface extending upwardly from the internal wall surface of the neck to the external wall surface of the neck, b) an inclined surface extending downwardly from the internal wall surface of the neck to the external wall surface of the neck, and c) both a first inclined surface extending upwardly from the internal wall surface of the neck and a second inclined surface extending upwardly from the external wall surface.

48. The system of claim 47, wherein the edge is provided on the external wall surface of the neck.

49. The system of claim 47, wherein the edge is provided on the external wall surface of the neck.

50. The system of claim 47, wherein the edge is provided between the internal wall surface of the neck and the external wall surface of the neck.

51. A nail varnish application system comprising:

a cap including internal screw threading;

a seal provided on a lower facing portion of the cap;

an applicator configured to apply nail varnish to a nail, the applicator including an elongated wand extending from the cap, and a nail varnish application member on an end of the wand; and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, an upper end of the external screw threading on the lower portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide the removal of the nail varnish from the edge, wherein the neck further comprises a shoulder where the upper portion of the neck adjoins the lower portion of the neck, the shoulder being defined by a difference in outer diameter between the upper portion of the neck and the lower portion of the neck, and wherein an outer diameter of each section of the upper portion of the neck is less than an outer diameter of each section of the lower portion of the neck.

52. A nail varnish application system comprising:

a cap including internal screw threading;

a seal provided on a lower facing portion of the cap;

an applicator configured to apply nail varnish to a nail, the applicator including an elongated wand extending from the cap, and a reservoir having an interior containing nail varnish, the reservoir being formed of a unitary, integral, single piece of glass material, the reservoir having a neck including an external wall surface, an internal wall surface defining a passage and an opening sized to permit the application member to pass into the reservoir via the opening and the passage, an upper portion including the opening, an upper part of the passage, and an upward-facing edge provided at an uppermost location of the reservoir, the edge providing a wiping surface for wiping excess nail varnish from the application member, and a lower portion adjoining the upper portion of the neck, the lower portion including a lower part of the passage and external screw threading configured to cooperate with the internal threading of the cap, an upper end of the external screw threading terminating on the lower portion of the neck, wherein the edge on the upper neck portion and the seal are configured such that when the cap is placed in a closed position on the reservoir by rotating the cap relative to the reservoir to cause cooperation between the internal screw threading of the cap and the external screw threading of the lower neck portion, the seal is forced against the edge on the upper neck portion to remove, from the edge, nail varnish transferred to the edge during wiping of the application member on the edge, wherein the edge of the upper neck portion has a sharpness sufficient to provide the removal of the nail varnish from the edge, wherein the neck further comprises a shoulder where the upper portion of the neck adjoins the lower portion of the neck, the shoulder being defined by a difference in outer diameter between the upper portion of the neck and the lower portion of the neck, and wherein a wall thickness of each section of the upper portion of the neck is less than a wall thickness of each section of the lower portion of the neck.

53. The system of claim 52, wherein a ratio of the wall thickness of the upper portion of the neck to the wall thickness of the lower portion of the neck is less than 0.9.

54. The system of claim 53, wherein the ratio ranges from 0.1 to 0.8.

55. The system of claim 46, wherein the edge is provided on the internal wall surface of the neck.

56. The system of claim 46, wherein the edge is provided on the external wall surface of the neck.

57. The system of claim 46, wherein the edge is provided between the internal wall surface of the neck and the external wall surface of the neck.

* * * * *

UNITED STATES PATENT AND TRADEMARK OFFICE

CERTIFICATE OF CORRECTION

PATENT NO. : 6,257,788 B1
DATED : July 10, 2001
INVENTOR(S) : Jean-Louis Gueret

It is certified that error appears in the above-identified patent and that said Letters Patent is hereby corrected as shown below:

Column 12, claim 36,
Line 31, "external" should read -- internal --.

Column 16, claim 48,
Line 27, "external" should read -- internal --.

Column 17, claim 52,
Line 25, "cap, and" insert -- a nail varnish application member on an end of the wand; and --.

Signed and Sealed this

Second Day of April, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,257,788 B1
DATED : July 10, 2001
INVENTOR(S) : Jean-Louis Gueret

It is certified that error appears in the above-identified patent and that said Letters Patent is hereby corrected as shown below:

Column 16,
Line 63, after "threading", please add -- terminating --.

Signed and Sealed this

Twenty-fourth Day of December, 2002

JAMES E. ROGAN
*Director of the United States Patent and Trademark Office*